United States Patent [19]

Hutson, Jr. et al.

[11] 4,206,035

[45] Jun. 3, 1980

[54] PROCESS FOR PRODUCING HIGH OCTANE HYDROCARBONS

[75] Inventors: Tom Hutson, Jr.; Francis M. Brinkmeyer, both of Bartlesville, Okla.

[73] Assignee: Phillips Petroleum Company, Bartlesville, Okla.

[21] Appl. No.: 933,938

[22] Filed: Aug. 15, 1978

[51] Int. Cl.[2] ..... C10G 35/08

[52] U.S. Cl. ..... 208/65; 208/62; 208/63; 585/419; 585/660

[58] Field of Search ..... 208/62, 63, 65; 260/680 R, 683.3, 673, 673.5

[56] References Cited

U.S. PATENT DOCUMENTS

| | | | |
|---|---|---|---|
| 2,654,694 | 10/1953 | Berger et al. . | |
| 2,853,437 | 9/1958 | Haensel . | |
| 2,915,455 | 12/1959 | Donaldson | 208/65 |
| 2,976,231 | 3/1961 | Bloch | 208/96 |
| 3,461,183 | 8/1969 | Hepp et al. | 260/680 R |
| 3,539,651 | 11/1970 | Hepp et al. | 260/680 R |
| 3,641,182 | 2/1972 | Box et al. | 260/680 R |
| 3,670,044 | 6/1972 | Drehman et al. | 260/683.3 |
| 3,894,110 | 7/1975 | Drehman | 260/680 R |
| 3,957,688 | 5/1976 | Farha et al. | 252/455 R |

*Primary Examiner*—C. Davis

[57] ABSTRACT

A process is disclosed for producing high octane hydrocarbons from a feed comprising paraffins having 5 to 9 carbon atoms which involves contacting the feed with steam and hydrogen in the presence of a steam active dehydrogenation catalyst wherein the amounts of steam and hydrogen employed relative to the feed are such that one obtains unexpectedly high conversion and unexpectedly high selectivity to high octane product.

18 Claims, 1 Drawing Figure

PROCESS FOR PRODUCING HIGH OCTANE HYDROCARBONS

Figure 1:
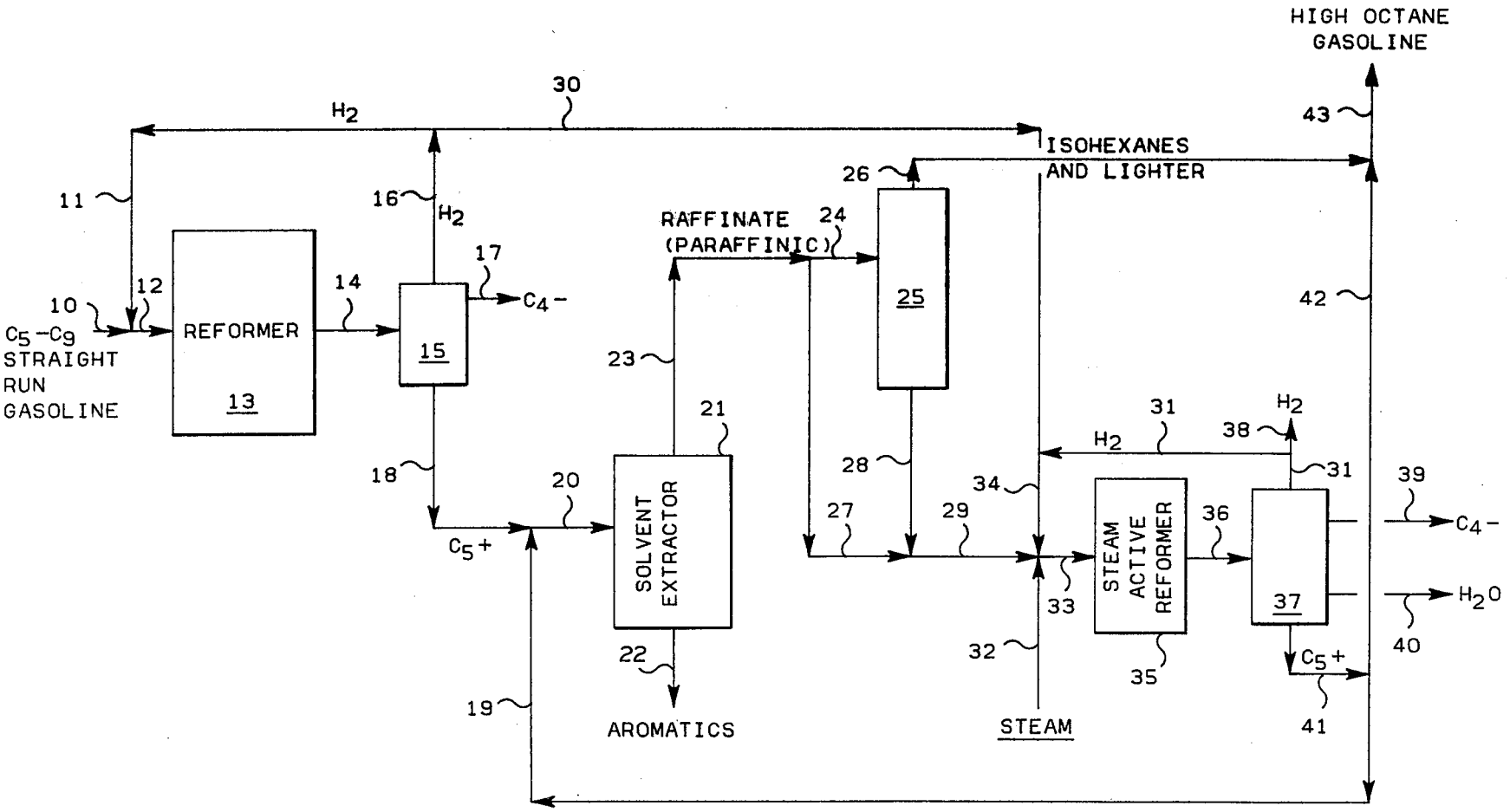

The invention relates to the production of high octane number hydrocarbons from paraffins having lower octane numbers. In another aspect this invention relates to a process for producing high yields of high octane hydrocarbons by catalytic dehydrogenation.

With the increasing emphasis upon obtaining high octane gasoline fuel without using additives such as tetraethyl lead, it has become increasingly more important to develop techniques for converting lower octane number hydrocarbons into higher octane hydrocarbons which can be used to provide high octane gasolines without the use of such metal additives.

It is known in the art that one can convert paraffins to higher octane hydrocarbons by employing a dehydrogenation process in which the low octane hydrocarbons are contacted with steam and hydrogen in the presence of a steam active dehydrogenation catalyst. One such process is disclosed in U.S. Pat. No. 3,670,044.

An object of the present invention is to provide a process in which one can obtain unexpectedly high yields of high octane number hydrocarbons from paraffins of lower octane number.

The present invention is based upon the discovery that the employment of certain molar ratios of hydrogen to hydrocarbon feed in combination with certain ratios of steam to hydrocarbon feed when a paraffin hydrocarbon feed is dehydrogenated by being contacted with steam and hydrogen in the presence of a suitable catalyst results in an improvement in both conversion and octane numbers of the product. The dehydrogenation is conducted such that at least part of the paraffinic hydrocarbons are cyclicized to aromatics.

In accordance with the present invention a process is provided in which a feed stream comprising paraffins having 5 to 9 carbon atoms is contacted with steam and hydrogen under dehydrogenation conditions in the presence of a steam active dehydrogenation catalyst comprising (1) a support selected from the group consisting of alumina, silica, mangesia, zirconia, alumina-silicate, Group II aluminate spinels and mixtures thereof and (2) a catalytic amount of at least one Group VIII metal selected from the group consisting of nickel, platinum, palladium, ruthenium, iridium, and osmium. In the invention the dehydrogenation is conducted with the molar ratio of gaseous hydrogen to hydrocarbon of said feed stream in the range of about 0.8/1 to about 1.3/1 and the molar ratio of steam to hydrocarbon of said feed stream in the range of about 7.5/1 to about 25/1. In a more preferred embodiment the molar ratio of gaseous hydrogen to hydrocarbon is greater than 1/1 but less than about 1.3/1. In a still more preferred embodiment the molar ratio of gaseous hydrogen to hydrocarbon is greater than 1/1 but not greater than about 1.2/1.

Catalysts suitable for use in this invention include those disclosed in U.S. Pat. Nos. 3,670,044; 3,957,688; 3,894,110; 3,641,182; 3,539,651 and 3,461,183, the disclosures of which are incorporated herein by reference.

As known in the art the support for such catalyst systems can be prepared by calcining for a sufficient time and at a sufficient temperature an alumina, silica, zinc oxide, magnesia, zirconia, alumina silicate, or Group II aluminate spinel, or mixtures thereof. (The groups of metals as referred to herein are the groups as classified in the Periodic Table published in the Chemical Rubber Company's "Handbook of Chemistry and Physics", 45th Edition ((1964)), page B-2).

Any catalytically active amount of Group VIII metal can be employed in the steam active dehydrogenation catalyst. Generally Group VIII metal is present in the catalyst in an amount in the range of about 0.01 to about 10 weight percent of the weight of the support, more preferably about 0.1 to about 5 weight percent, and still more preferably about 0.1 to about 1 weight percent. The catalyst composition employed in this invention can be prepared by combining with the support, in any manner known to the art, certain Group VIII metals, or metal compounds capable of reduction to the metal including nickel, platinum, ruthenium, palladium, iridium, rhodium, osmium, and mixtures thereof. Platinum, which is very effective, is preferred.

Any group VIII metal compound that produces the desired results can be used. In the discussion of the compounds that can be used the platinum compounds will be used in nonlimiting examples. It is to be understood that similar compounds of the other Group VIII metal can be used. Examples of simple or noncoordination compounds that can be used are platinic chloride, chloroplatinic acid, ammonium chloroplatinate, and the like. Nonlimiting examples of coordination platinum compounds that can be used are: platinum aminoacetate, platinum dimethyl dioxime, tetraaminoplatinum hydroxide, platinum diamine dinitrate, platinum tetraamine dihydroxide, platinum diamino dihydroxide, platinum hexamine dihydroxide, platinum hexamine tetrahydroxide, platinum diamine tetrahydroxide, platinum diamine dihydroxide dinitrate, platinum diamine tetranitrate, platinum diamine dinitrite, platinum tetramine dicarbonate, platinum diamine oxalate, and the like. Additionally, many complex or coordination divalent tetravalent platinum compounds are known and can be used.

When added to the support by impregnation from solution, some of the compounds can be added from aqueous solution, but others will require nonaqueous solvents such as alcohols, hydrocarbons, ethers, ketones, and the like.

Other suitable copromoter metals can also be employed in the steam active dehydrogenation catalyst in conjunction with the Group VIII metal. A preferred type of such co-promoters are Group IVa metals selected from the group of lead, tin, and germanium. The Group IVa metal can exist in the range of about 0.01–10 weight percent of said support, and in one embodiment, can exist in the range of about 0.1–1 weight percent of said support, and in one further embodiment, can exist in the range of about 0.1–0.5 weight percent of said support. Although any Group IVa metal, when in compound form, is fully within the scope of this invention, some convenient compounds are the halides, nitrates, oxalates, acetates, carbonates, propionates, tartrates, bromates, chlorates, oxides, hydroxides, and the like of tin, germanium and lead. Tin, itself, is the preferred Group IVa metal and impregnation of the supports with tin compounds such as the stannous halides in particularly effective and convenient.

Generally speaking, the Group VIII and Group IVa compounds, which can be combined with the supports to form the catalysts used in the present invention, can be any compound in which all elements, other than those of Group VIII, or Group IVa, are volatilized during calcination. These compounds can be sequentially combined with the support, in any order, or for convenience, can be applied simultaneously in a single impregnation operation. After impregnation, the composite solids are dried and calcined.

The catalyst process of this invention is operated at temperatures between 950° and 1,150° F., preferably between 1,000° to 1,100° F., and at total pressures in the range of 0 to 200 psig, preferably 0 to 100 psig. As stated above the steam to hydrocarbon mode ratio is in the range of about 7.5/1 to about 25/1 and the hydrogen gas to hydrocarbon mole ratio is in the range of about 0.8/1 to about 1.3/1, more preferably greater than 1/1 but less than 1.3/1, and still more preferably greater than 1/1 but less than 1.2/1. The weight hourly space velocity, i.e. weight of hydrocarbon per weight of catalyst per hour) is generally in the range of about 1 to about 4. Preferably the dehydrogenation is carried out in the absence of free oxygen.

Additional features, advantages and uses of the present invention will be apparent from the following description of the accompanying drawing which illustrates diagrammatically a method for conducting gasoline reforming employing the present inventive dehydrogenation process. For simplification of the drawing, many values, pumps, heat exchangers, etc. have been excluded as those skilled in the art would readily be able to supply them to achieve the ends described below.

In the drawing a feedstock comprising straight run gasoline (comprising paraffinics and naphthenics) is charged via line 10 along with hydrogen supplied via line 11 to a reforming zone 13 wherein, mainly, naphthenics are dehydrogenated to aromatics, and, in addition, some paraffins are cyclicized and dehydrogenated to aromatics. Suitable processes for achieving such reforming are known in the art. Examples of such are shown in U.S. Pat. Nos. 2,654,694; 2,853,437; 2,915,455, and 2,976,231 the disclosures of which are incorporated herein by reference. The effluent from the reforming zone is passed via line 14 to a separation zone 15 wherein the reformate is separated into (1) a gaseous hydrogen-containing stream which passes via line 16 for reuse in the process, and (2) a liquid stream comprising generally pentanes and heavier hydrocarbons. Also in a preferred embodiment butanes and lighter hydrocarbons are recovered from the separation zone via line 17. The liquid stream 18 from separation zone 15 is passed via line 20 to a solvent extraction system 21 wherein the liquid stream is separated into an aromatics-rich fraction substantially free of non-aromatics and a paraffinic-containing fraction. The aromatics-rich fraction, rich in benzene, toluene, and xylenes are passed from the solvent extraction system via line 22 for recovery or other use as desired. The individual aromatics can be separated from each other by fractionation if desired, and the xylenes can be further separated, e.g. by fractional crystallization and fractionation into orthoxylene, metaxylene, and paraxylene.

The solvent extraction can be carried out using any suitable techniques known in the art. Solvents generally used for such purposes include triethylene glycol, diethylene glycol, phenol, liquid $SO_2$, and the like.

The raffinate of solvent extraction zone enriched in paraffins is passed from that zone via line 23. At least a portion of the paraffins of that raffinate having 5 to 9 carbon atoms is passed via line 27 and line 29 to a zone 35 wherein that portion is subjected to dehydrogenation and cyclization in accordance with the instant invention.

In a preferred embodiment not all of the raffinate from the solvent extraction zone 21 is passed to the dehydrogenation zone 35. Instead the raffinate from the solvent extraction zone 21 is passed via 24 into a deisohexanizer 25 wherein the raffinate from the solvent extraction zone is separated into a low boiling fraction rich in isohexanes and hydrocarbons boiling lower than isohexanes and a high boiling fraction comprising one or more paraffins boiling higher than isohexanes and having 5 to 9 carbon atoms. In that embodiment the low boiling fraction is passed to a point of recovery via line 26 and the high boiling fraction is passed via line 28 to line 29 for dehydrogenation.

The paraffin in line 29 along with hydrogen from line 34 (and line 30) and steam from line 32 are then passed via line 33 to the dehydrogenation zone 35. The effluent from zone 35 is passed via line 36 to a separation zone 37 wherein hydrogen is removed and recycled via line 31 for reuse in the dehydrogenation process. Also, if desired portions of excess hydrogen can be withdrawn via line 38 for use in other operations such as, for example, hydrodesulfurization and hydrodenitrification of hydrocarbons containing undesirable amounts of sulfur and nitrogen compounds. Also in the separation zone butanes and lighter hydrocarbons are removed via line 39 and water is removed via line 40. The water of course can be reheated and used as steam in some part of the system. The high octane product is removed from separation zone 37 via line 41 from where it can be passed via line 42 and line 43 for blending with the stream of line 26 for use as a high octane blending component for the preparation of gasoline. Optionally, a portion of the high octane product in line 41 can be recycled via line 19 to extraction zone 21.

Although the illustrated process has been described in regard to the processing of straight run gasoline it is generally applicable to the processing of any hydrocarbons that boil within the gasoline range. The preferred feedstocks in line 10 are those consisting essentially of naphthenes and paraffins, although aromatics and minor amounts of olefins may be present. The preferred feedstocks thus include straight run gasoline, natural gasoline, and the like. The gasoline fraction may be a full boiling range gasoline having an initial boiling point within the range of from about 50° F. to about 100° F. and an end boiling point within the range of from about 350° F. to about 425° F. or it may be a select fraction thereof, usually a higher boiling fraction commonly referred to as naphtha and having an initial boiling point within the range of from about 150° F. to about 250° F. and an end boiling point within the range of from about 350° F. to about 425° F. Mixtures of various gasolines and/or gasoline fractions may also be used, including thermally cracked and/or catalytically cracked gasolines. In general, however, when the latter unsaturated gasoline fractions are used, it is preferred that they be used either in admixture with a straight run or natural gasoline fraction, or else hydrogenated prior to use.

The present invention will be further illustrated by the data in Table I. These data were developed from actual dehydrogenation reactions in a pilot plant. The same feedstock was used for all the reactions. The feedstock contained about 26 mole percent normal hexane, about 57.6 mole percent heptanes, about 12.5 mole percent octanes, and about 3.9 mole percent aromatics. The catalyst employed in each reaction was the same and consisted essentially of platinum and tin supported on zinc aluminate spinel. The amount of platinum was about 1.0 weight percent and the tin about 0.6 weight percent, based upon the weight of these support. The dehydrogenation reactions were also carried out under essentially the same temperature and pressure conditions.

Table I

| | | Run I | Run II | Run III |
|---|---|---|---|---|
| (32)** | Steam, cc/hr. (measured as liquid) | 2156 | 2213 | 2123 |
| (34) | Hydrogen, SCF/hr. | 4.42 | 8.25 | 8.45 |
| | Weight Hourly Space Velocity | 2 | 2 | 2 |
| | $H_2$/Hydrocarbon Mol Ratio | 0.64 | 1.20 | 1.28 |
| | Steam/Hydrocarbon Mol Ratio | 14.53 | 14.95 | 14.91 |
| | Conversion per pass, wt. % | 75.9 | 81.9 | 80.7 |
| (41) | Product, RON* Clear | 97.0 | 99.6 | 97.5 |

*Research Octane Number, Occ TEL.
**Numbers in parenthesis refer to relevant zones in the attached drawing.

The above data illustrate that improvements in both conversion and the octane number of the product are obtained when the hydrogen to hydrocarbon mole ratio is 1.2 or 1.28 rather than 0.64.

From the foregoing description, one skilled in the art can easily ascertain the essential characteristics of this ivention. Various modifications and changes can be made in the invention without departing from the scope or spirit thereof.

What is claimed is:

1. A process for producing high octane hydrocarbons from a feed stream comprising paraffins having 5 to 9 carbon atoms; said process comprising contacting said feed stream with steam and gaseous hydrogen under dehydrogenation conditions in the presence of a steam active dehydrogenation catalyst comprising (1) a support selected from the group consisting of alumina, silica, magnesia, zirconia, alumina-silicates, Group II aluminate spinels and mixtures thereof, and (2) a catalytic amount of at least one Group VIII metal selected from the group consisting of nickel, platinum, palladium, ruthenium, iridium, rhodium, and osmium; wherein the molar ratio of gaseous hydrogen to hydrocarbon of said feed stream is greater than 1/1 but no greater than about 1.3/1 and the molar ratio of steam to hydrocarbon of said feed stream is in the range of about 7.5/1 to about 25/1.

2. A process according to claim 1 wherein the molar ratio of gaseous hydrogen to hydrocarbon of said feed stream is greater than 1/1 but no greater than about 1.2/1.

3. A process according to claim 2 wherein the Group VIII metal of said steam active dehydrogenation catalyst is platinum and the platinum is present in an amount in the range of from about 0.01 to about 10 weight percent of the weight of said support.

4. A process according to claim 3 wherein said support of said catalyst comprises zinc aluminate spinel, said platinum is present in the range of about 0.1 to about 5 weight percent of said zinc aluminate spinel, and said catalyst further includes tin in an amount in the range of about 0.01 to about 5 weight percent of said zinc aluminate spinel.

5. A process according to claim 4 wherein said platinum is present in an amount in the range of about 0.1 to about 1 weight percent of said support and said tin is present in an amount in the range of about 0.1 to about 1 weight percent.

6. A process according to claim 5 wherein the pressure of the dehydrogenation condition is in the range of from about 0 to about 200 psig and the temperature of the dehydrogenation conditions is in the range of about 950° F. to about 1,150° F.

7. A process according to claim 6 wherein the molar ratio of steam to hydrocarbon of said feed stream is about 15.

8. A process according to claim 7 wherein said catalyst consists essentially of said support, platinum, and tin, the amount of platinum is about 1.0 weight percent of said support, and the amount of tin is about 0.6 weight percent of said support.

9. A process according to claim 8 wherein the molar ratio of hydrogen to hydrocarbon of said feed stream is about 1.2.

10. A process for the production of high octane number aromatics comprising reforming in the presence of hydrogen a paraffin-containing feed comprising hydrocarbons boiling in the gasoline range, separating the reformate into a gaseous hydrogen-containing stream and a liquid stream, separating the liquid stream into an aromatics-rich fraction substantially free of non-aromatics and a paraffinic-containing fraction, and subjecting at least a portion of the paraffins of said paraffin-containing fraction having 5 to 9 carbon atoms to dehydrogenation employing a process according to claim 1.

11. A process according to claim 11 wherein the paraffin-containing fraction is separated into a low-boiling fraction rich in isohexanes and hydrocarbons boiling lower than isohexanes and a high-boiling fraction comprising one or more paraffins boiling higher than isohexanes and having 5 to 9 carbon atoms, and only said high boiling fraction is subjected to said dehydrogenation.

12. A process according to claim 10 wherein the portion of said paraffinic-containing fraction that is subjected to dehydrogenation is a portion which substantially free of isohexanes and hydrocarbons boiling lower than isohexanes.

13. A process according to claim 12 wherein said support of said catalyst comprises zinc aluminate spinel, said Group VIII metal is platinum, and the platinum is present in an amount in the range of from about 0.01 to about 10 weight percent of the weight of said support.

14. A process according to claim 13 wherein said platinum is present in the range of about 0.1 to about 1 weight percent of said zinc aluminate spinel, and said catalyst further includes tin in an amount in the range of bout 0.01 to about 1 weight percent of said zinc aluminate spinel.

15. A process according to claim 14 wherein said dehydrogenation is carried out under pressure in the range of about 0 to about 200 psig and under temperatures in the range of about 950° F. to about 1,150° F.

16. A process according to claim 15 wherein said catalyst consists essentially of said support, platinum, and tin; the amount of platinum is about 1.0 weight percent of said support, and the amount of tin is about 0.6 weight percent of said support.

17. A process according to claim 16 wherein said dehydrogenation is carried out with the molar ratio of steam to hydrocarbon of said feed stream being about 15 and the molar ratio of hydrogen to hydrocarbon about 1.2.

18. A process according to claim 17 wherein the product of said dehydrogenation is combined with said low boiling fraction rich in isohexanes to produce a high octane number blending stock.

* * * * *